US006138644A

United States Patent [19]

Saruwatari et al.

[11] Patent Number: 6,138,644

[45] Date of Patent: Oct. 31, 2000

[54] APPARATUS AND METHOD FOR PROCESSING FUEL VAPOR IN INTERNAL COMBUSTION ENGINE

[75] Inventors: Masayuki Saruwatari; Junichi Furuya, both of Atsugi, Japan

[73] Assignee: Unisia Jecs Corporation, Atsugi, Japan

[21] Appl. No.: 09/199,280

[22] Filed: Nov. 25, 1998

[30] Foreign Application Priority Data

Sep. 12, 1997 [JP] Japan ..... 9-338775

[51] Int. Cl.[7] ..... F02M 37/04

[52] U.S. Cl. ..... 123/520; 123/519

[58] Field of Search ..... 123/516, 518, 123/519, 520, 521

[56] References Cited

U.S. PATENT DOCUMENTS

| | | | |
|---|---|---|---|
| 4,541,396 | 9/1985 | Sato et al. | 123/520 |
| 5,005,550 | 4/1991 | Bugin, Jr. et al. | 123/520 |
| 5,183,023 | 2/1993 | Hanson | 123/520 |
| 5,190,015 | 3/1993 | Nakata et al. | 123/520 |
| 5,269,278 | 12/1993 | Heinemann et al. | 123/520 |
| 5,349,935 | 9/1994 | Mezger et al. | 123/520 |
| 5,881,700 | 3/1999 | Gras et al. | 123/520 |
| 5,918,580 | 7/1999 | Hennrich et al. | 123/520 |

FOREIGN PATENT DOCUMENTS

| | | |
|---|---|---|
| 58-110852 | 7/1983 | Japan . |
| 1-58760 | 4/1989 | Japan . |
| 5-312113 | 11/1993 | Japan . |

*Primary Examiner*—Thomas N. Moulis
*Attorney, Agent, or Firm*—Foley & Lardner

[57] ABSTRACT

A purge passage is communicated to the upstream side of a compressor of a turbosupercharger, and on the other hand, a purge control valve and an electrically powered pump are mounted in the middle of said purge passage. Then, either a constant drive current is provided to said electrically powered pump, and the opening of the purge control valve is controlled in correspondence to the requested purged air flow rate, or the purge control valve is controlled to be fully opened, and the drive current of said pump is controlled in correspondence to the requested purged air flow rate.

5 Claims, 3 Drawing Sheets

APPARATUS AND METHOD FOR PROCESSING FUEL VAPOR IN INTERNAL COMBUSTION ENGINE

BACKGROUND OF THE INVENTION (1) Field of the Invention

The present invention relates to an apparatus and method for processing fuel vapor in an internal combustion engine constituted to adsorb the fuel vapor generated in a fuel tank to a canister, and to supply a purged air of the canister to the intake air passage of the engine for combustion.

(2) Related Art of the Invention

A fuel vapor processing apparatus is conventionally known for absorbing the fuel vapor generated in the fuel tank to a canister temporarily, while introducing new air into the canister by the negative pressure of a throttle valve so as to purge the fuel vapor, and then supplying the purged air into the engine for combustion (refer for example to Japanese Unexamined Utility Model Publication No. H1-58760).

According to the structure as shown above where the purging is performed by the negative pressure of the throttle valve, there was a problem that the purged air may not be supplied when the pressure inside the intake air passage is changed to positive pressure due to a supercharge, in the case where the purge passage is communicated to the intake air passage on the downstream side of a compressor in a combustion engine equipped with a supercharger.

The purged air may be supplied during supercharged states by applying a structure to communicate the purge passage to the intake air passage on the upstream side of the compressor. However, due to the change in pressure on the upstream side of the compressor according to various driving conditions, there was a problem that the flow rate of the purged air may not be controlled accurately.

SUMMARY OF THE INVENTION

The present invention aims at solving the above-mentioned problems, and the object of the present invention is to provide an apparatus and method for processing fuel vapor capable of accurately controlling a flow rate of purged air without being influenced greatly by a pressure condition inside an intake air passage for supplying the purged air.

In order to achieve the above-mentioned object, the fuel vapor processing apparatus of the internal combustion engine according to the present invention includes a pump equipped in the middle of a purge passage.

According to such structure, the purged air is not supplied to the intake air passage of the engine due to a differential pressure, but instead, the pump induces the purged air and forces the air into the intake air passage of the engine, so the supply of the purged air may be performed without being greatly influenced by the pressure in the intake air passage to where the purged air is to be supplied.

Moreover, according to the apparatus and method for processing fuel vapor in the internal combustion engine of the present invention, the pump is electrically powered, so the flow rate of the purged air may be controlled by controlling the drive current of the electrically-powered pump.

According to such structure, by controlling the drive current of the electrically-powered pump, a discharge flow rate of the pump may be controlled, and as a result, the flow rate of the purged air may be controlled.

Moreover, according to the apparatus and method for processing fuel vapor in the internal combustion engine of the present invention, the pump is electrically powered, and a purge control valve is further equipped to the purge passage, wherein the opening of the purge control valve is controlled while the drive current of the electrically powered pump is controlled to a constant value so as to control the flow rate of the purged air.

According to such structure, while the electrically powered pump is driven to a constant value, the opening of the purge control valve, or in other words, the effective opening area of the purge passage is controlled so as to control the flow rate of the purged air.

In this case, when the internal combustion engine comprises a supercharger, the purge passage may be communicated to the intake air passage on the upstream side of the compressor of the supercharger.

According to such structure, the purged air is supplied to the intake air passage on the upstream side of the compressor by a pump, so as to provide the purged air to the intake prior to being supercharged by the supercharger. Therefore, the supply of purged air may be performed even when the supercharging is carried out, and at the same time, the flow rate of the purged air may be controlled accurately without being largely influenced by the change in pressure on the upstream side of the compressor.

These and other objects and phases of the present invention will become apparent from the following description on the embodiments with regard to the accompanied drawings.

DETAILED DESCRIPTION OF THE PREFERRED EMBODIMENT

The preferred embodiment according to the present embodiment will now be explained.

Figure 1:
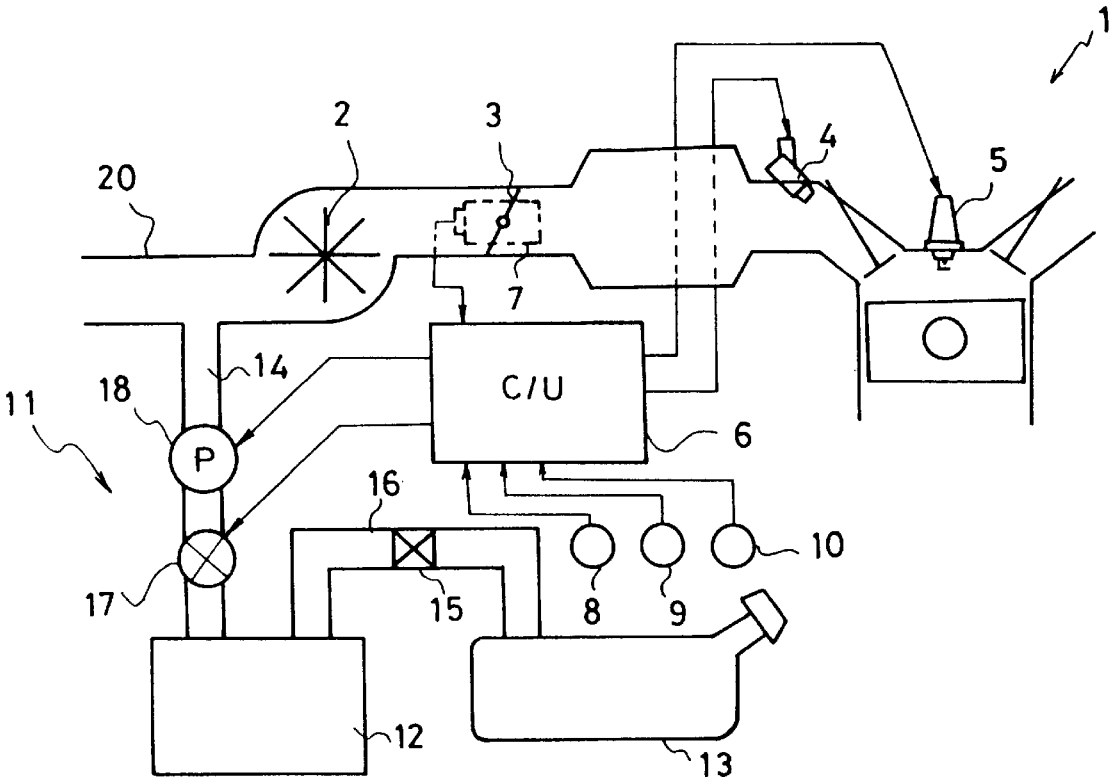
FIG. 1 is a view showing the system structure of the internal combustion engine according to the embodiment.

FIG. 1 is a view showing the system structure of the internal combustion engine equipped with the apparatus and method of processing the fuel vapor according to the present invention.

In FIG. 1, a turbosupercharger is equipped to an internal combustion engine 1 as a supercharger, and intake air supercharged by a compressor 2 of the turbosupercharger is adjusted of its flow rate by a throttle valve 3, and sucked into the engine 1.

A fuel injection valve 4 is equipped on an intake port portion of each cylinder, and the fuel injected by the fuel injection valve 4 and the intake air are mixed so as to form an air-fuel mixture. The air-fuel mixture is ignited and combusted by a spark ignition performed by an ignition plug 5 mounted on each cylinder.

A control unit 6 for controlling the fuel injection performed by the fuel injection valve 4 and the ignition performed by the ignition plug 5 includes a microcomputer, and based on detection signals from various sensors, calculates a quantity of fuel injection or ignition timing, and outputs an injection pulse signal to the fuel injection valve 4 and outputs an ignition signal to the ignition plug 5.

A throttle sensor 7 for detecting the opening of the throttle valve 3, an airflow meter 8 for detecting a flow rate of intake air of the engine 1, a crank angle sensor 9 for detecting the crank angle, a water temperature sensor 10 for detecting a temperature of the cooling water and the like are mounted thereto as the various sensors. Further, the engine rotation speed NE is calculated based on a detection signal from the crank angle sensor 9.

On the other hand, a fuel vapor processing apparatus 11 is equipped on the engine 1. The fuel vapor processing apparatus 11 adsorbs and collects fuel vapor generated inside a fuel tank 13 by an adsorbent of activated carbon and the like filled inside a canister 12, purges the fuel adsorbed by the adsorbent, and supplies the purged air into the intake air passage of the engine 1 through a purge passage 14. The purge passage 14 is communicated to an intake air passage 20 on the upstream side of the compressor 2.

The fuel vapor inside the fuel tank 13 is introduced to the canister 12 through a fuel vapor passage 16 equipped with a check valve 15 which is set to be opened when the pressure inside the fuel tank 13 is raised to a predetermined value or more.

Moreover, the purge passage 14 is equipped, in the order from the upstream to the downstream, with an electromagnetic-type purge control valve 17 and an electrically powered pump 18. When a drive current is applied to the electrically powered pump 18 while the purge control valve 17 is at an opened state, the fuel vapor captured by the canister 12 is sucked together with new air by the electrically powered pump 18, and supplied to the intake air passage 20 on the upstream side of the compressor 2.

As above, the supply of purged air may be per formed even during the supercharged states by adopting the structure to supply the purged air to the intake passage 20 on the upstream side of the compressor 2, and even further, by adopting the structure to supply the purged air forcibly by the electrically powered pump 18, the flow rate of the purged air may be controlled relatively accurately even when the pressure inside the intake passage 20 on the upstream side of the compressor 2 is varied.

Figure 2:
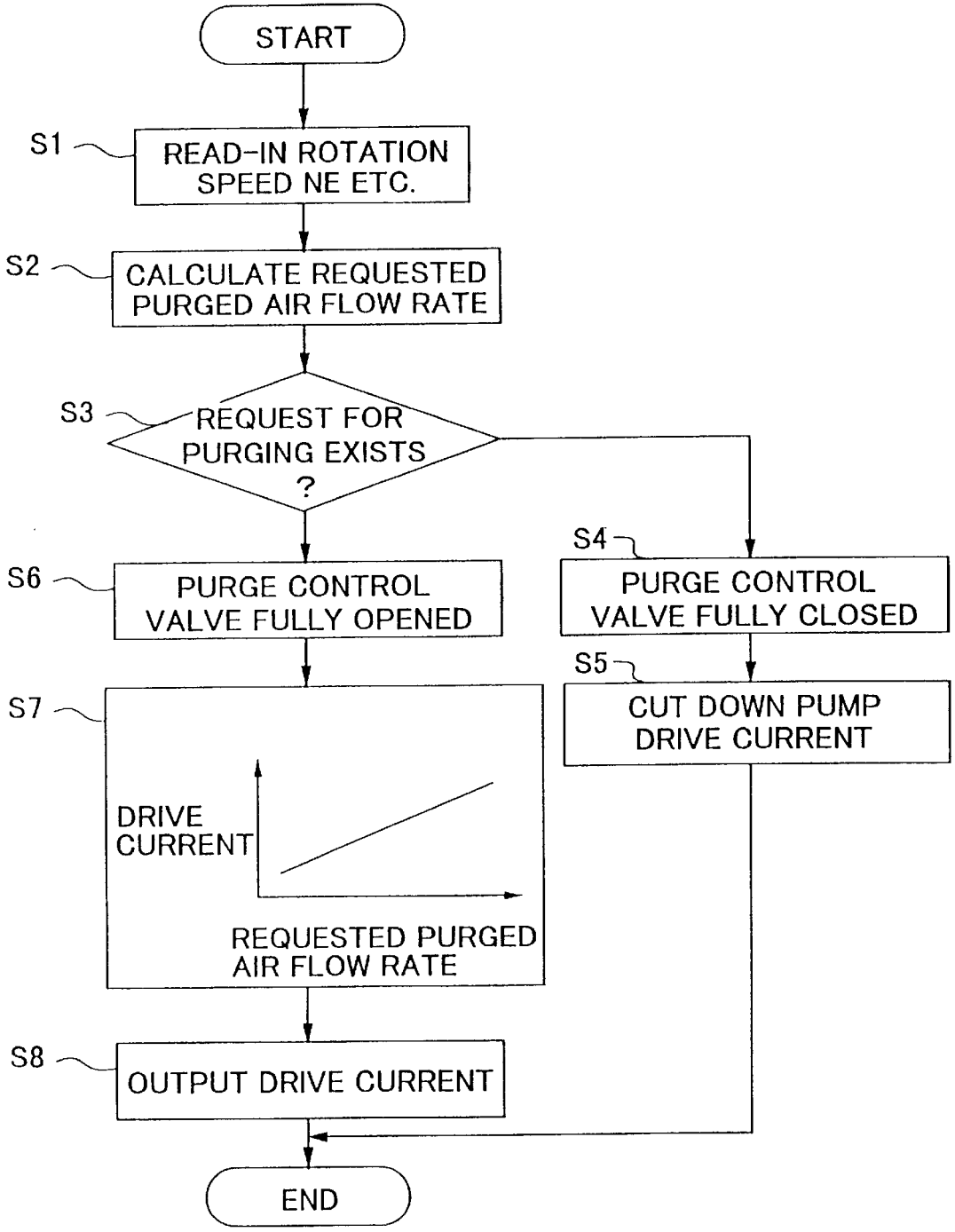
FIG. 2 is a flowchart showing a first embodiment of the flow rate control of the purged air.

Now, the control of the flow rate of the purged air by the control unit 6 according to the above-mentioned structure is explained according to the flowchart of FIG. 2. In the present embodiment, as shown in the flowchart of FIG. 2, the control unit 6 is equipped with a function as the flow rate control device.

According to the flowchart of FIG. 2, in S1, the driving conditions such as engine rotation speed NE, the intake air flow rate, the water temperature and the like are read in.

In S2, a requested purged air flow rate is calculated based on the driving conditions read in at S1.

In S3, a judgment is made on whether the request for purging the canister exists or not, based on whether the requested purged air flow rate is zero or not. When there is no request for purging the canister, the procedure is advanced to S4, where the purge control valve 17 is controlled to be fully closed. In S5, the supply of drive current to the pump 18 is stopped.

On the other hand, when it is judged in S3 that the request for purging the canister exists, then the procedure is advanced to S6, where the purge control valve 17 is controlled to be fully opened. In S7, the drive current to the pump 18 is determined based on the requested purged air flow rate.

In S8, the drive current determined at S7 is output to the pump 18.

In the above structure, the purged air flow rate is controlled according to the drive current applied to the pump 18. However, it is also possible to control the purged air flow rate by controlling the opening of the purge control valve 17 while providing a constant drive current to the pump 18.

Figure 3:
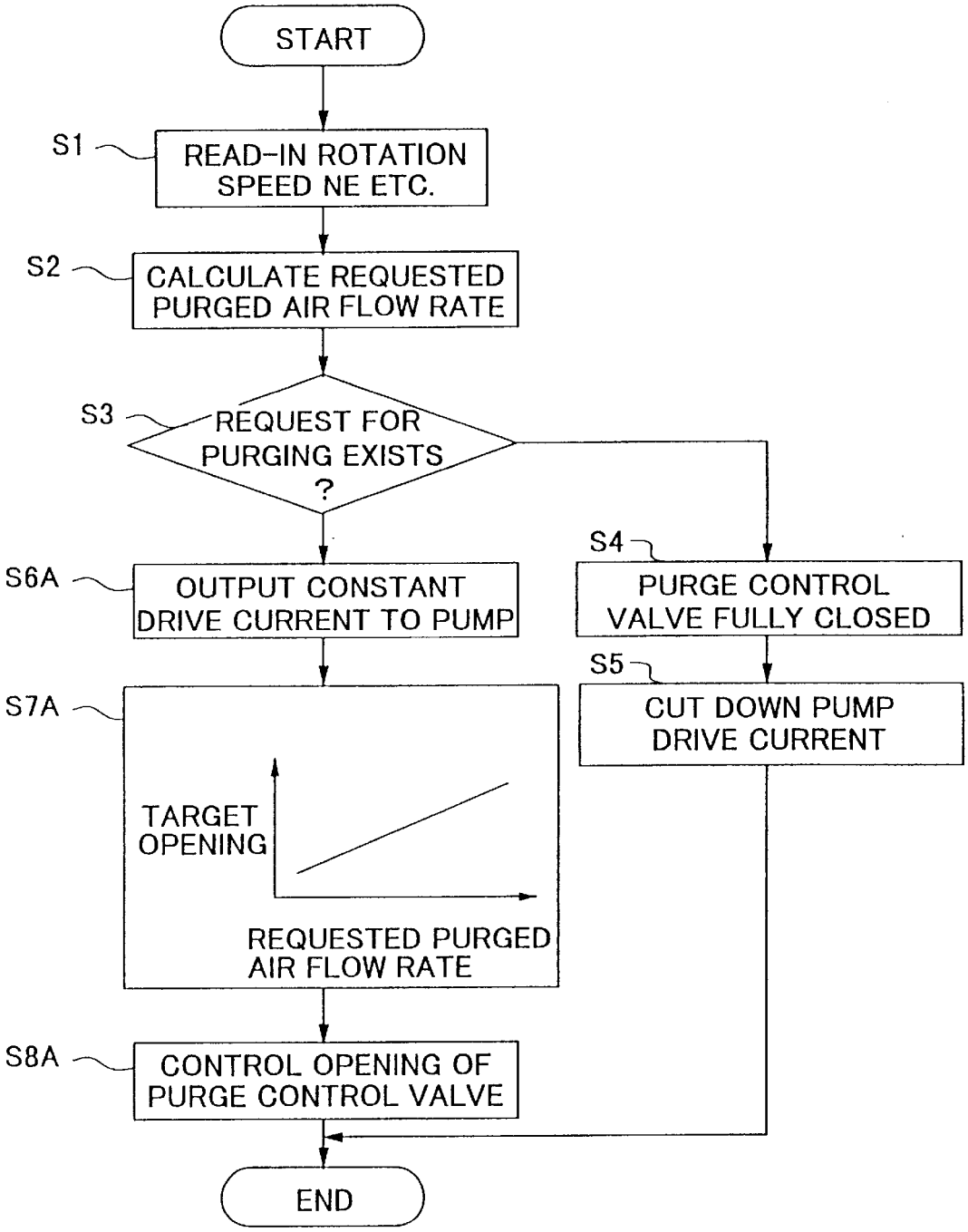
FIG. 3 is a flowchart showing a second embodiment of the flow rate control of the purged air.

The flowchart of FIG. 3 shows an embodiment of controlling the purged air flow rate by adjusting the opening of the purge control valve 17 as mentioned above. Only S6A, S7A and S8A differ from the flowchart of FIG. 2.

When it is judged that a request for purging the canister exists in S3, then the procedure is advanced to S6A, where a constant drive current set in advance is output to the pump 18.

In the next step S7A, a target opening of the purge control valve 17 is determined based on the requested purged air flow rate.

Then, in S8A, the opening of the purge control valve 17 is controlled to the target opening. The opening control of the purge control valve 17 may be performed for example by controlling the duty of the power supplied to an electromagnetic coil.

In the above, a turbosupercharger was equipped to the engine as the supercharger. However, the engine may be equipped with a mechanically driven supercharger. For example, in an engine equipped with a mechanically driven supercharger whose compressor is positioned on the downstream side of the throttle valve, the purged air may be supplied to the upstream side of the compressor, and the portion where the purged air is supplied may either be on the upstream side or the downstream side of the throttle valve, as long as it is on the upstream side of the compressor.

Moreover, the purge control valve 17 is not limited to an electromagnetic-type valve, but may be driven to open and close by a step motor and the like.

What we claimed are:

1. A fuel vapor processing apparatus in an internal combustion engine equipped with a supercharger comprising a compressor mounted in an intake air passage, said fuel vapor processing apparatus comprising:

a canister for adsorbing fuel vapor being generated in a fuel tank;

a purge passage for communicating said canister to said intake air passage on the upstream side of said compressor; and a pump mounted in the middle of said purge passage.

2. A fuel vapor processing apparatus in an internal combustion engine equipped with a supercharger according to claim 1, wherein said pump is an electrically powered pump, and said processing apparatus is further equipped with a flow rate control means for controlling a flow rate of purged air by controlling a drive current being supplied to said electrically powered pump.

3. A fuel vapor processing apparatus in an internal combustion engine equipped with a supercharger according to claim 1, wherein said pump is an electrically powered pump, said purge passage is equipped with a purge control valve for controlling the opening of said purge passage, and said processing apparatus is further equipped with a flow rate control means for controlling a flow rate of purged air by controlling the opening of said purge control valve while controlling a drive current being supplied to said electrically powered pump to a constant value.

4. A method of processing fuel vapor in an internal combustion engine equipped with a supercharger comprising a compressor mounted in an intake air passage, comprising the steps of:

adsorbing fuel vapor generated in a fuel tank by a canister, supplying purged air of said canister to an intake air passage on the upstream side of said compressor through a purge passage in which an electrically power pump is mounted, and controlling a flow rate of said purged air by controlling a drive current being supplied to said electrically powered pump.

5. A method of processing fuel vapor in an internal combustion engine equipped with a supercharger comprising a compressor mounted in an intake air passage, comprising the steps of:

adsorbing fuel vapor generated in a fuel tank by a canister, supplying purged air of said canister to an intake air passage on the upstream side of a compressor through a purge passage in which an electrically power pump and a purge control valve are mounted, and controlling a flow rate of said purged air by controlling the opening of said purge control valve while controlling a drive current being supplied to said electrically powered pump to a constant value.

* * * * *

UNITED STATES PATENT AND TRADEMARK OFFICE

CERTIFICATE OF CORRECTION

PATENT NO. : 6,138,644
DATED : October 31, 2000
INVENTOR(S) : Masayuki Saruwatari et al.

It is certified that error appears in the above-identified patent and that said Letters Patent is hereby corrected as shown below:

Title page,
Item [30], Foreign Application Priority delete "Sept. 12, 1997 [JP] Japan 9-338775" and insert -- Dec. 9, 1997 [JP] Japan 9-338775 --.

Signed and Sealed this

Ninth Day of July, 2002

*Attest:*

*Attesting Officer*

JAMES E. ROGAN
*Director of the United States Patent and Trademark Office*